United States Patent [19]

Gray, III

[11] 4,327,121

[45] Apr. 27, 1982

[54] RELEASE COATINGS

[75] Inventor: Lorin S. Gray, III, Portland, Me.

[73] Assignee: Scott Paper Company, Philadelphia, Pa.

[21] Appl. No.: 193,191

[22] Filed: Oct. 2, 1980

[51] Int. Cl.[3] ..... B05D 3/06

[52] U.S. Cl. ..... 427/44; 156/247

[58] Field of Search ..... 156/239, 245, 246, 247; 427/44, 54.1, 147

[56] References Cited

U.S. PATENT DOCUMENTS

| | | | |
|---|---|---|---|
| 3,793,102 | 2/1974 | Day | 156/247 |
| 3,929,545 | 12/1975 | Van Dyck et al. | 156/247 |
| 4,016,333 | 4/1977 | Gaske et al. | 427/44 |
| 4,030,955 | 6/1977 | Antonio et al. | 156/235 |
| 4,041,200 | 8/1977 | Boranian et al. | 156/247 |
| 4,138,508 | 2/1979 | Spatz et al. | 427/54.1 |

*Primary Examiner*—John H. Newsome

*Attorney, Agent, or Firm*—R. Duke Vickrey; John W. Kane; Francis M. DiBiase

[57] ABSTRACT

Disclosed is a release coating composition having acrylic functional materials which have been polymerized by electron beam radiation, about 15% to about 85% of the acrylic functional material being provided by one or more aliphatic noncyclic monofunctional acrylates and the remainder of the acrylic functional material being provided by one or more multi-functional acrylates.

16 Claims, No Drawings

RELEASE COATINGS

TECHNICAL FIELD

The present invention relates to coatings for paper and other sheet-like substrates, and particularly to release coatings which are characterized by their ability to separate intact from a surface which is normally adherent.

BACKGROUND ART

A number of processes exist in which a plastic sheet or film is formed on or against a release sheet and then separated from the release sheet after taking steps, such as cooling or curing, to set the sheet or film. Curing, where necessary, may be accomplished by heat, by peroxide catalyst, or U.V. radiation or by electron beam radiation. The release sheet provides a surface from which the set plastic material can be readily separated and imparts to the surface of the plastic material the quality of finish of the release surface. For example, a desired textured surface can be provided on the surface of the plastic material by forming on or against a release sheet having the reverse surface effect of the desired textured surface.

One example of such forming processes is "casting," wherein a resinous material, such as polyvinyl chloride or polyurethane resin, in a flowable state is deposited or "cast" onto the release sheet surface, heated, cured and cooled to consolidate the resinous material into a continuous self-supporting film, and stripped from the support. The release sheet is normally provided with a desired surface effect, such as high gloss, texturing or an embossed configuration, and the reverse of the surface effect is replicated on the cast film.

Another example of such forming processes is "panel pressing" of decorative plastic laminates, which can be either of the high pressure or low pressure type. In high pressure panel pressing, decorative laminates are conventionally prepared by assembling in a stacked relationship a plurality of core sheets, each of which is a web of paper impregnated with a resinous material, such as phenolic resin. Immediately positioned above the core sheet assembly is a decorative sheet, which is a resin saturated sheet having a solid color or a suitable design thereon. Superimposed above the decorative sheet is generally an overlay sheet which is a thin sheet of fine paper impregnated with a noble thermosetting resin, such as a melamine formaldehyde resin or an unsaturated polyester resin and the like (and is generally the same resin used to impregnate the decorative sheet). The entire assembly of core sheets, decorative sheet, and overlay sheet is placed between platens in a press and consolidated by application of heat and pressure. Generally, a release sheet having the desired surface effect to be reproduced in reverse in the surface of the overlay sheet is placed against the overlay sheet during pressing. High pressure laminates after being consolidated are usually further glued to a structural substrate, such as particle board or plywood. Low pressure panel pressed decorative laminates are made in a similar manner to high pressure laminates, but generally involve lamination of the decorative sheet directly to particle board or other structural substrate.

Other pressing processes where a plastic sheet or film is formed on or against a release sheet may not include the lamination step, but only texturing a moldable plastic surface which is already laminated. For example, a plastic film could be coated directly onto particle board or plywood and then textured by pressing against a release sheet having the desired textured pattern in its surface while setting the plastic film. (See, for example, U.S. Pat. No. 4,113,894 to Koch.)

Other uses for release sheets include heat transferable printed designs, pressure sensitive adhesive coated webs, and interleavers for panel pressing. The heat transferable printed designs are printed on the release sheet with a polyvinyl chloride plastisol ink or offset printing ink and overcoated with a polyvinyl chloride plastisol. When placed against a receptive surface, such as a T-shirt, and heated, the printed design and overlayer are transferred to the receptive surface where it sets upon cooling. In this application, the release surface must be capable of being printed upon and capable of releasing the printed material and overlying layer of polyvinyl chloride plastisol when it is transferred.

On the other hand, pressure sensitive coated webs are typically adhesive coated tapes, labels or decals and the like which are attached to a release surface for easy removal later when it is desired to permanently attach them to an object. The release surface must permit temporary attachment of the pressure sensitive adhesive, but also permit easy removal. The pressure sensitive adhesive laminates can be formed by coating a film of the adhesive onto the release surface and then attaching the backing sheet (i.e., tape), or the adhesive can be first coated on the backing sheet and then laminated to the release sheet.

An interleaver is a release sheet placed between groups of heat and pressure consolidated laminae pressed at the same time in back-to-back configuration to form two distinct decorative laminates. The release sheet in this case separates the laminates from each other and thereby permits more than one to be pressed at the same time between the same platens. (See, for example, U.S. Pat. No. 4,030,955 to Antonio et al.)

Release sheets are typically produced by coating, treating, or impregnating a paper web or other sheet-like substrate with a release coating of such materials as polymethylpentene, polypropylene, polyfluorocarbons, silicone oil, thermoset silicone resins, and other conventional release agents. Usually, release papers comprise a base sheet provided with at least one first coating, conventionally referred to as a base coating, and a release coating overlying the base coating. The base coating typically comprises a pigment or filler, such as a paper coating grade clay together with an adhesive binder. The purpose of the base coating is to level and seal the surface. The pigment in the coating provides a smooth surface by masking the irregularities in the surface of the base sheet, and the adhesive binds the pigment and prevents undue penetration into the base sheet by the subsequently applied release coating. The base coating thereby maximizes the effectiveness of the release coating applied by preventing excessive penetration of the release coating into the body-stock.

Surface effects on the release sheet, when desired, are conventionally provided by any one of a number of techniques. The release coating can be dried to a smooth surface gloss or surface effects such as texturing or embossing can be provided in the coating by mechanical means, applied either to the surface of the base paper before coating or to the paper after the release coating is applied. Another technique employed for producing a release coating with a textured surface is to extrude a molten thermoplastic film, such as polypropylene or polymethylpentene, onto a paper surface, cool it and then pass it between matched steel embossing rolls.

DISCLOSURE OF THE INVENTION

In accordance with the present invention, a release coating is provided by a coating composition having acrylic functional material which has been polymerized by electron beam radiation. From about 15% to about 85% of the acrylic functional material is provided by one or more aliphatic non-cyclic monofunctional acrylates (having one acrylic functional group per molecule before polymerization), and the remainder is provided by one or more multi-functional acrylates (having two or more acrylic functional groups per molecule).

The aliphatic non-cyclic monofunctional acrylate material is necessary to provide the superior release performance of which the invention is capable. However, monofunctional acrylates cannot practically be crosslinked without the addition of some multifunctional acrylate material, preferably having three or more acrylic functional groups per molecule. A portion of the multi-functional acrylate material can be provided by di-functional acrylates, and even all of it can be so provided if a longer cure time or poorer release performance can be tolerated.

It is preferable that the monofunctional acrylate material provide from about 33% to about 66% of the total acrylate material in the coating composition but acceptable although poorer performance can be obtained with less, down to about 15%, or more, up to about 85%, of the total acrylic material being monofunctional. The chain length of the monofunctional acrylate material also affects the release performance of the coating composition. Such material having a molecular weight of from 128 to 380 provides acceptable performance. However, performance dramatically improves with an increase in molecular weight from 128 up to about 212. Above a molecular weight of 212, a further increase in chain length improves release performance at a slower rate. The most preferred molecular weight range is from 212 to 324.

Another advantage of the monofunctional acrylates in the coating composition is that they have less sensitivity to dose rate changes than do multi-functional acrylates. That is, a given dosage applied to a given acrylate composition will provide poorer release properties as the rate of applying that dose is increased, but this sensitivity is decreased as the percentage of monofunctional material in the composition is increased.

The present invention is also an improvement in a method of forming a plastic sheet or film on or against an easy release surface, setting the plastic sheet or film, and stripping it from the release surface. The improvement is the release surface being provided by a substrate coated on at least one side with the coating composition described above. The invention surprisingly provides a release surface which is satisfactory for most if not all forming materials. There is no need to employ conventional release agents, such as polysiloxanes, and a preferred form of the invention uses a nonpolysiloxane containing coating composition.

The term "forming" is used herein in a broad sense and includes the actual formation of a plastic sheet or film from a flowable state as well as the pressing of a moldable, already-existing plastic sheet or film. In some embodiments, the plastic sheet or film is provided by a polyvinyl chloride plastisol or polyurethane which is cast onto the release surface in a flowable state and set to provide a surface effect which is the reverse of the release surface. In other embodiments, the plastic sheet or film is provided by an outermost lamina in a heat and pressure consolidated decorative laminate which is pressed against the release surface. Where the lamina pressed against the release surface is the decor sheet, or overlay sheet if one is used, the surface of the decor sheet or overlay sheet will be molded during consolidation to have a surface effect which is the reverse of the release surface. Where the lamina pressed against the release surface is the back most lamina which will later be glued to a reinforcing substrate, the release surface substrate is coated on both sides with the release coating composition and is an interleaver separating two groups of laminae consolidated in back-to-back configuration.

The invention is also a composite comprising a sheet-like substrate, with the coating composition described above on at least one side of the substrate to provide a release surface, and on top of the release surface, a strippable sheet or film. The substrate is preferably provided by paper coated with a base coat to reduce penetration of the release surface coating into the paper substrate. The strippable sheet or film can be provided by, for example, cast and set films of such materials as polyvinyl chloride and polyurethane, one or more laminae in a consolidated decorative laminate, or the transferable film in a heat transferable printed design. Such composites can be sold intact for later uses which require stripping of the sheet or film from the release surface.

The polymerization energy is provided by conventional electron beam radiation units readily available. They typically consist of a transformer capable of stepping up line voltage and an electron accelerator. In one type of machine the electrons are generated from a point source filament and then scanned electromagnetically like a television set to traverse the coated object. In another type of machine, the electrons are generated in a curtain from an extended filament which can irradiate the entire width of the surface without the need for scanning. While commercial machines are available with accelerating voltages of over a million electron volts, the range for this and similar coating applications is typically from 150–300 KV (kiloelectron volts).

The coating applied to the paper must be capable of being cured by electron beam radiation, and the polymerization energy for the release coating must be provided by electron beam radiation. It is the combination of the particular acrylic functional material and the electron beam radiation which surprisingly provides the superior release properties of the invention. Coatings of this type may be polymerized by a variety of other means, such as heat, catalyst and UV radiation, but only electron beam radiation will satisfactorily provide the release properties of the invention. On the other hand, acrylates are the primary group of polymerizable materials which has a fast enough cure rate to be able to use beneficially the high energy of electron beam radiation. Electron beam radiation energy level per electron is much greater than the energy level of, for example, a photon of UV radiation, and electron beams can readily penetrate into and cure a thick coating.

The major component of electron-beam curable formulas suitable for the invention is an acrylic functional oligimer or monomer. The coating composition can include materials other than the acrylic functional material. For example, viscosity control additives, such as colloidal silica or volatile solvents, or surface texture materials, such as starch grains or silica, might be included. Conventional release agents, such as polysiloxanes, can also be added for specific uses, such as when curing the coating composition against another surface or film, which tends to decrease the release properties of the cured coating, although they are unnecessary for satisfactory release in most cases. In addition, filler material such as conventional paper coating pigments can be included to reduce costs of the coating. However, the amount of acrylic functional material in the coating composition must be sufficient to provide a continuous, hard, polymerized layer in the areas where it is coated. It is preferable that the acrylic functional material provide at least about 30% by weight of the total coating composition, and more preferable that it provide at least about 40%.

The release coating composition can be coated on a variety of sheetlike substrates, such as paper, metal foils, and plastic films. It is highly desirable that the substrate be somewhat resistant to penetration of the release coating composition to provide a hold-up function which maximizes efficiency of the coating composition, although sufficient penetration of the coating into the substrate is required. The substrate is preferably paper with a base coat to prevent excessive penetration of the release coating composition. Paper is highly desirable because of its low cost, flexibility and other physical properties.

BEST MODE FOR CARRYING OUT THE INVENTION

The following examples illustrate the invention.

Paper substrates having an uncoated basis weight of about 89–142 grams per square meter (60–96 lbs. per ream) and a 15–22 grams per square meter (10–15 lbs. per ream) base coat of a conventional pigment/adhesive dispersion were top coated with the coating compositions described below. The coatings were polymerized with electron beam radiation in a nitrogen atmosphere at the line speeds (in meters per minute) and dosages listed below and with 175 KV acceleration potential. In the examples, the coatings polymerized satisfactorily to a dry hard state and were tested for release properties by casting a film of polyurethane resin onto the release surface, drying for 1½ minutes at 100° C. in a non-circulating air oven and curing for 1½ minutes at 160° C. in an air circulating oven to form an approximately 25.4 microns (1 mil) thick film. The film in each example was stripped from the release surface in an Osgood-Sutermeister release tester, which provides a comparative measurement of the energy required to strip a sample of the cured film 3.8 cm.×7.7 cm. from the release papers, and found to strip satisfactorily with the surface effect of the release surface replicated in reverse in the film. Cast polyurethane films tend to adhere very tightly to release surfaces, and stripping energy requirements below 70 Joules per square meter indicates that the surface is suitable for urethane release. However, the present invention provides much better performance than that for most urethane films and provides about that level or better for very hard to strip urethanes. The polyurethanes tested for release were: (1) Impranil D-353-a 35% solids dispersion of urethane in dimethyl formamide, supplied by Verona Dyestuff Div. of Mobay Chemical Corp., and (2) ENBO1, a very difficult to strip urethane prepared as a 25% dispersion in a 3:2 DMF/MEK solution and provided by Bayer Chemical Co.

The coating materials employed in the examples are listed below and designated by letters. The materials were mixed in the ratios indicated, by weight.

| Material Designation | Material Description |
|---|---|
| A | Oligimer, an aliphtic Bisphenol A-diepoxide diacrylate of medium molecular weight, Dow Chemical XD-9016 (two acrylic functional groups per molecule). |
| B | Acrylic monomer, 1,6-hexanediol diacrylate. (two acrylic functional groups per molecule). |
| C | Acrylic monomer, butyl acrylate. (one acrylic functional group per molecule, aliphatic, molecular weight 128). |
| D | Acrylic monomer, trimethylolpropane triacrylate. (three acrylic functional groups per molecule). |
| E | Acrylic monomer, neopentylglycol diacrylate. (two acrylic functional groups per molecule). |
| F | Acrylic monomer, phenoxyethylacrylate. (one acrylic functional group per molecule). |
| G | Acrylic monomer, isodecylacrylate. (one acrylic functional group per molecule, aliphatic, molecular weight 212). |
| H | n-Hexyl acrylate. (aliphatic, one acrylic functional group per molecule - molecular weight 156). |
| I | Hydroxyethyl acrylate. (one acrylic functional group per molecule). |
| J | Methoxyethyl acrylate. (one acrylic functional group per molecule). |
| K | Cyclohexyl acrylate. (cyclic monofunctional acrylate-molecular weight 155). |
| L | Lauryl ($C_{12}$) acrylate. (monofunctional aliphatic-molecular weight 240). |
| M | Octadecyl acrylate. (monofunctional aliphatic-molecular weight 324) |

| Example No. | Coating Composition | Ratio of Components | Radiation Dose (megarads) | Line Speed (mpm) | Release Force ($J/M^2$) (1) | (2) |
|---|---|---|---|---|---|---|
| 1 | D | — | 2 | 5.5 | 23 | |
| 2 | E/D | 1:2 | 4 | 5.5 | 23 | |
| 3 | A/D | 1:2 | 4 | 5.5 | 29 | |
| 4 | B/D | 1:2 | 4 | 5.5 | 29 | |
| 5 | F/D | 1:2 | 4 | 5.5 | 18 | |
| 6 | G/D | 1:2 | 2 | 5.5 | <6 | |
| 7 | H/D | 1:2 | 2 | 5.5 | 6 | |
| 8 | D/E | 1:2 | 4 | 5.5 | 18 | |
| 9 | E | — | 4 | 5.5 | 23 | |
| 10 | B/E | 1:2 | 4 | 5.5 | 18 | |
| 11 | F/E | 1:2 | 2 | 5.5 | 12 | |
| 12 | G/E | 1:2 | 2 | 5.5 | <6 | |
| 13 | H/E | 1:2 | 2 | 5.5 | 6 | |
| 14 | I/E | 1:2 | 4 | 5.5 | 35 | |
| 15 | J/E | 1:2 | 4 | 5.5 | 12 | |
| 16 | E/A | 1:2 | 4 | 5.5 | 47 | |
| 17 | A | — | 2 | 5.5 | 41 | |
| 18 | B/A | 1:2 | 4 | 5.5 | 35 | |
| 19 | G/A | 1:2 | 6 | 5.5 | 12 | |
| 20 | D/B | 1:2 | 4 | 5.5 | 29 | |
| 21 | E/B | 1:2 | 6 | 5.5 | 18 | |
| 22 | A/B | 1:2 | 4 | 5.5 | 29 | |
| 23 | B | — | 4 | 5.5 | 35 | |
| 24 | G/B | 1:2 | 4 | 5.5 | 6 | |
| 25 | C/D | 1:1 | 4 | 30.5 | 12 | 41 |
| 26 | H/D | 1:1 | 4 | 30.5 | 12 | 35 |
| 27 | K/D | 1:1 | 4 | 30.5 | 12 | 76 |
| 28 | G/D | 1:1 | 4 | 30.5 | 6 | 12 |
| 29 | H/G/D | 2:1:3 | 4 | 30.5 | 12 | 18 |
| 30 | L/G/D | 2:1:3 | 4 | 30.5 | 6 | 12 |
| 31 | M/G/D | 2:1:3 | 4 | 30.5 | 6 | 12 |
| 32 | H/D | 1:1 | 2 | 61 | 23 | >120 |
| 33 | G/D | 1:1 | 2 | 61 | 12 | 64 |
| 34 | H/G/D | 2:1:3 | 2 | 61 | 18 | >120 |
| 35 | L/G/D | 2:1:3 | 2 | 61 | 6 | 23 |

-continued

| Example No. | Coating Composition | Ratio of Components | Radiation Dose (megarads) | Line Speed (mpm) | Release Force ($J/M^2$) (1) | (2) |
|---|---|---|---|---|---|---|
| 36 | M/G/D | 2:1:3 | 2 | 61 | 6 | 12 |

The preferred forms of the coating composition of the invention are capable of providing release for a wide variety of fibers and sheets formed on or against them. For example, Example 28 was tested satisfactorily for release of vinyl, urethane, and acrylic films cast upon it, transfer printing, panel pressing interleavers, high pressure and low pressure melamine pressing, polyester pressing and epoxy panel pressing. No prior art release coatings can provide such versatility.

What is claimed is:

1. In a method of forming a plastic sheet or film on or against an easy release surface, setting the plastic sheet or film and stripping it from the release surface, the improvement wherein the release surface is provided by a substrate coated on at least one side with a coating composition comprising acrylic functional material which has been polymerized on the substrate by electron beam radiation, of which from about 15% to about 85% by weight of the acrylic functional material is provided by one or more aliphatic non-cyclic monofunctional acrylates having a molecular weight of from 212 to 324 before polymerization and the remainder is provided by one or more multi-functional acrylates.

2. The method of claim 1, wherein the plastic sheet or film is cast onto the release surface in a flowable state.

3. The method of claim 2, wherein the plastic sheet or film is polyurethane.

4. The method of claim 2, wherein the plastic sheet or film is polyvinyl chloride plastisol.

5. The method of claim 1, wherein the plastic sheet or film is one lamina in a decorative heat and pressure consolidated decorative laminate and is pressed against the release surface during consolidation of the laminate.

6. The method of claim 5, wherein the plastic sheet or film pressed against the surface is the decor sheet or overlay sheet, and the release sheet forms a surface effect in the decor sheet or overlay.

7. The method of claim 5, wherein the plastic sheet or film pressed against the release sheet is the back most lamina which will later be glued to a reinforcing substrate, and the release surface substrate is coated on both sides with the coating composition and is an interleaver separating two groups of laminae consolidated in back-to-back configuration.

8. The method of claim 1, wherein the acrylic functional material provides at least 30% by weight of the coating composition.

9. The method of claim 8, wherein the acrylic functional material provides at least 40% by weight of the coating composition.

10. The method of claim 1, wherein some of the acrylic functional material has 3 or more acrylic groups per molecule before polymerization.

11. The method of claim 1, wherein the coating composition contains no polysiloxane release agent.

12. The method of claim 1, wherein the monofunctional acrylate material provides from about 33% to about 66% of the total acrylic functional materials in the coating composition.

13. A composite comprising a sheet-like substrate, a coating on at least one side of the substrate of a coating composition comprising an acrylic functional material which has been polymerized on the substrate by electron beam radiation to provide a release surface, and on top of the release surface, a strippable sheet or film, from about 15% to about 85% of the acrylic functional material being provided by one or more aliphatic non-cyclic monofunctional acrylates having a molecular weight of from 212 to 324 before polymerization and the remainder being provided by one or more multi-functional acrylates.

14. The composite of claim 13, wherein the sheet-like substrate is paper and further including between the substrate and release surface a base coat to reduce penetration of the release surface coating into the paper substrate.

15. The composite of claim 13, wherein the coating composition contains no polysiloxane release agent.

16. The composite of claim 13, wherein the monofunctional acrylate material provides from about 33% to about 66% of the total acrylic functional materials in the coating composition.

* * * * *